United States Patent [19]

Hill

[11] Patent Number: 4,465,255

[45] Date of Patent: Aug. 14, 1984

[54] BEDSIDE BOOK HOLDER

[76] Inventor: David F. Hill, 544 E. Pearl St., Butler, Pa. 16001

[21] Appl. No.: 342,384

[22] Filed: Jan. 25, 1982

[51] Int. Cl.[3] ..... A47B 23/00

[52] U.S. Cl. ..... 248/441.1; 5/507; 108/1; 248/445; 248/447; 248/451

[58] Field of Search ..... 248/441 A, 445, 447, 248/451, 454, 460, 166, 281.1, 558; 108/1, 12; 5/508, 507, 503

[56] References Cited

U.S. PATENT DOCUMENTS

| | | | |
|---|---|---|---|
| 213,706 | 3/1879 | Stice et al. | 5/507 X |
| 439,186 | 10/1890 | Reams | 248/466 X |
| 473,150 | 4/1892 | Fales | 248/451 |
| 490,569 | 1/1893 | Lehman | 248/441 B |
| 664,419 | 12/1900 | Luby | 248/451 |
| 1,083,764 | 1/1914 | Smith . | |
| 1,385,279 | 7/1921 | Schechter | 297/103 |
| 1,719,614 | 7/1929 | McIntosh | 5/507 X |
| 1,916,667 | 7/1933 | Hoogendyk . | |
| 2,546,283 | 3/1951 | Webster . | |
| 2,771,705 | 11/1956 | Rettinger . | |
| 3,057,112 | 10/1962 | Bergman | 248/454 |
| 3,091,886 | 6/1963 | Nutting . | |
| 3,130,925 | 4/1964 | Appleton | 240/52 |
| 3,351,312 | 11/1967 | Ballas . | |
| 3,618,145 | 11/1971 | Rowe | 5/507 |
| 3,790,770 | 2/1974 | Stern . | |
| 3,889,914 | 6/1975 | Torme . | |
| 3,905,573 | 9/1975 | Davis . | |
| 4,321,917 | 3/1982 | Campbell | 248/445 X |

*Primary Examiner*—J. Franklin Foss
*Assistant Examiner*—David L. Talbott
*Attorney, Agent, or Firm*—Buell, Blenko, Ziesenheim & Beck

[57] ABSTRACT

The invention comprises a flat base member which is inserted between the mattress and spring of a bed, a pair of arms of different lengths, each of which is pivoted at one end in an end of the base member, and at the other end to an end of a preferably transparent table on which the reading material rests face down. The pivot arrangements on the table are such that the article can be adapted for use on either side of a bed.

6 Claims, 3 Drawing Figures

BEDSIDE BOOK HOLDER

This invention relates to a bedside holder for books or other reading material. It is more particularly concerned with a book holder which allows such material to be read by a person lying in bed.

BACKGROUND OF THE INVENTION

Reading in bed is a pastime for some individuals and a necessity for would-be readers who are confined to their beds. For many individuals it is most comfortable to lie in bed but reading in that position is possible only if the book or other reading material is held above the reader's head face down. Various devices have been proposed to hold reading material in that position, for example, the transparent tables of Smith U.S. Pat. No. 1,083,764, Hoogendyk U.S. Pat. No. 1,916,667, Webster U.S. Pat. No. 2,546,283 and Stern U.S. Pat. No. 3,790,770. The device of Webster merely rests on the bed but the others either clamp to the bed or are floor mounted. None of these are easily adjusted in position or moved out of the way by the person in bed.

SUMMARY OF THE INVENTION

It is an object of my invention to provide an improved holder or support apparatus for a table, transparent or otherwise, suitable for positioning reading material over the head of a reader lying in bed which is readily adjusted or moved out of the way by the reader. It is a further object to provide such apparatus which is supported by the bed but not clamped or otherwise attached thereto. It is another object to provide such apparatus which without being removed from the bed can be transferred to an out-of-the-way position which does not in any way obstruct the bed. It is yet another object to provide such apparatus which is readily adjusted to use on either side of a bed. Other objects of my invention will appear from the description thereof which follows.

My invention comprises a flat base member which is inserted between the mattress and spring of a bed, a pair of arms of different lengths, each of which is pivoted at one end in an end of the base member, and at the other end to an end of a preferably transparent table on which the reading material rests face down. The pivot arrangements on the table are such that the article can be adapted for use on either side of a bed.

BRIEF DESCRIPTION OF THE DRAWINGS

An embodiment of my invention presently preferred by me is illustrated in the attached figures to which reference is now made.

DESCRIPTION OF THE PREFERRED EMBODIMENT

Figure 1:
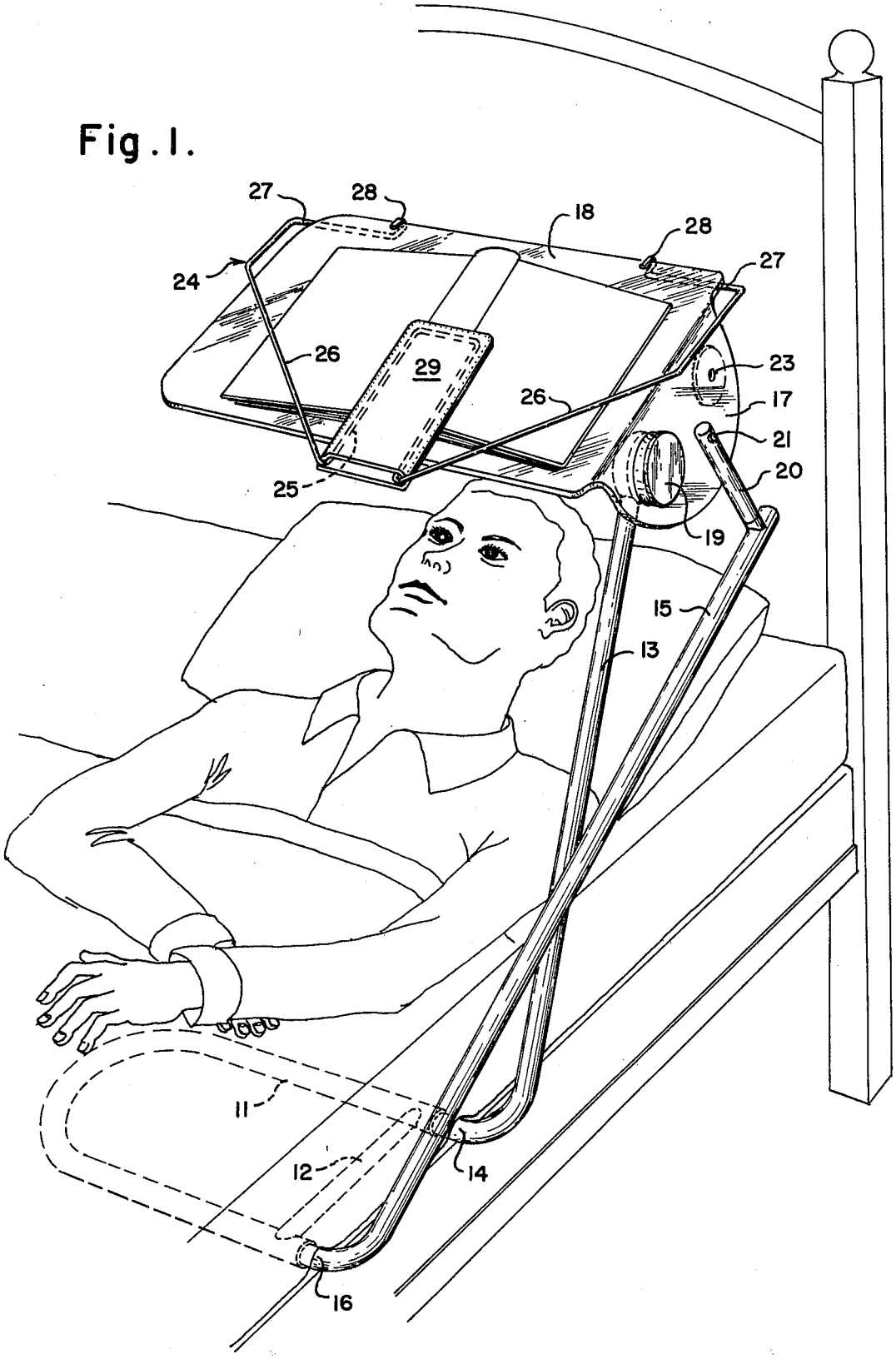
FIG. 1 is an isometric representation of my article in use on a bed.

The base of my apparatus is conveniently formed of a U-shaped tubular member 11 stiffened by a tubular cross brace 12 adjacent its open end. A first arm 13 has one end 14 bent at right angles thereto and pivoted within the open end of one leg of member 11. A second arm 15 has one end 16 bent at right angles thereto and pivoted within the open end of the other leg of member 11, but so as to pivot in a plane parallel to but spaced from the plane in which arm 13 pivots. The other end of arm 13 is pivotally mounted on a depending end flange 17 of a flat table 18. That pivotal mounting is made through a positive clutch device 19 which may be locked against relative movement between arm 13 and flange 17. Clutch 19 is of a type known to the art and is disclosed in Stern U.S. Pat. No. 3,790,770 previously mentioned.

Figure 3:
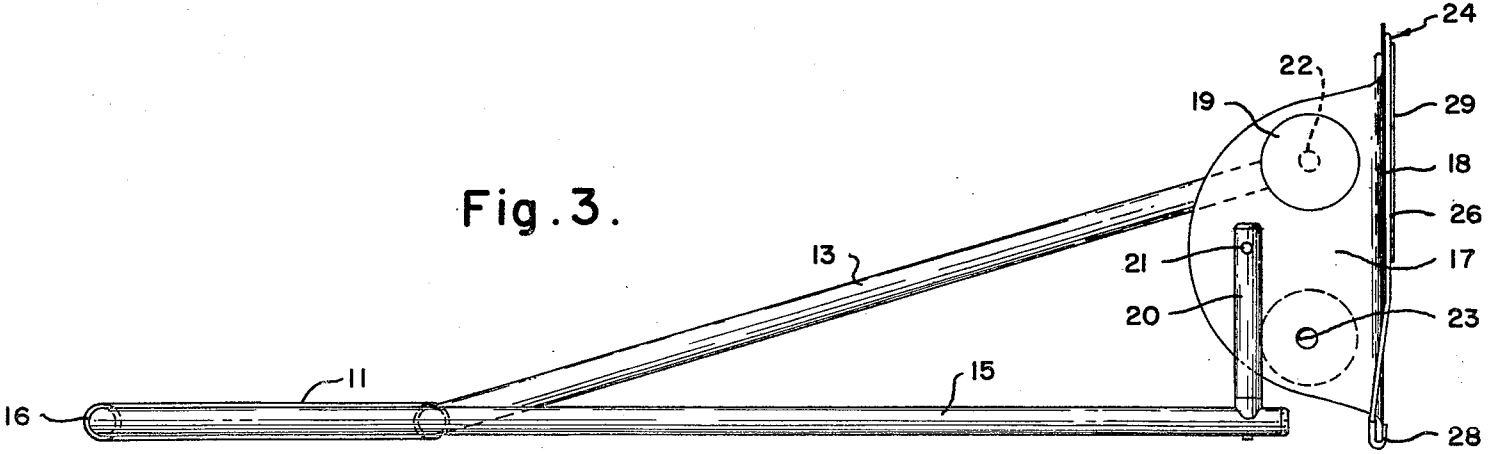
FIG. 3 is a elevation of the apparatus of FIG. 2.

The other end of arm 15 is fitted with a short riser 20 at right angles thereto. Riser 20 is conveniently attached with a screw through a hole in arm 15, not shown, so that it can project therefrom in either of two directions 180° apart in the plane in which arm 15 pivots. The free end of riser 20 is pivotally connected to flange 17 by a fastener 21 which is spaced from table 18 a distance greater than the spacing between that table and clutch 19 and is centrally located with respect to the width of table 18. It will be seen from FIG. 3 that the lengths of arms 13 and 15 are proportioned so that when arm 15 is horizontal table 18 is vertical.

Clutch 19 is detachably mounted on flange 17 by a pin which passes through a hole 22 in that flange which is adjacent one end thereof. Flange 17 is also formed with a second hole 23 adjacent its other end symmetrically positioned with respect to hole 22 in the flange. Hole 23 provides an alternative mounting for clutch 19 which, together with the alternative position of riser 20 on arm 15, make my device readily adapted for use on either side of a bed.

I also fit a wire clamp 24 on my table 18 to hold reading material in place. Clamp 24 has an inverted U-shaped tongue portion 25, the open ends of which adjoin the lower edge of table 18. The legs of the tongue extend upwardly and outwardly as arms 26 across the top face of the table 18 to its ends, are then bent into portions 27 which extend under table top 18 parallel to its upper edge for a short distance and are then further bent into two hooks 28 which are at right angles to portions 27 and clamp over the upper edge of table 18. Clamp 24 so formed holds reading material against transparent table 18 face down as is shown in FIG. 1. An envelope 29 of a textile or other flexible material is slipped over tongue portion 25 to inhibit sliding motion between the reading material and table 18.

Figure 2:
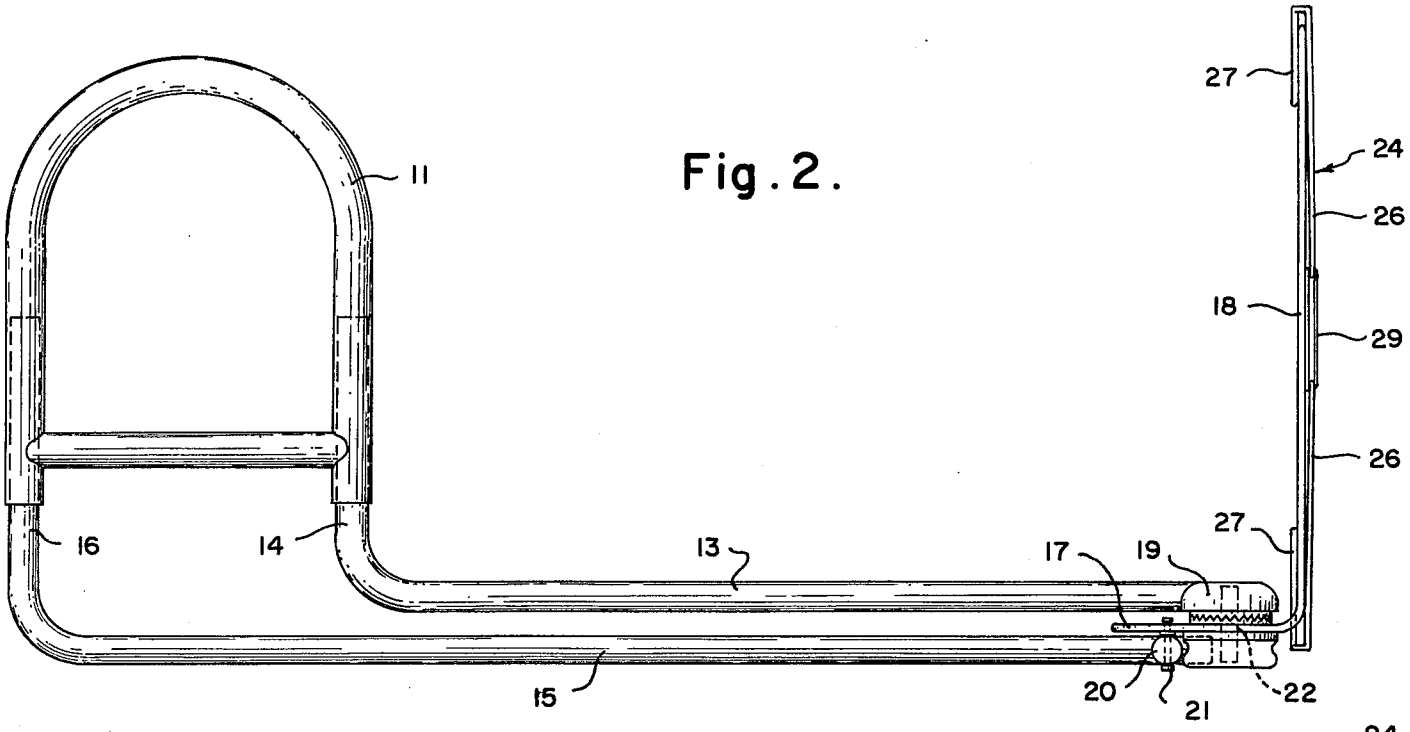
FIG. 2 is a plan of the apparatus of FIG. 1 but with the table top lowered to a position normal to its base.

The method of using my device will be evident from the above description and the appended figures. When table 18 is not required it is moved into its position shown in FIG. 2 where it is normal to arm 15 and may be fitted between the mattress and the headboard of the bed. When it is required, table 18 is pulled up and away from the headboard into a position such as is shown in FIG. 1. It is locked in the desired position by tightening clutch 19.

As clamp 24 is attached to table 18 only by its hooks 28 which engage the upper edge of table only, its tongue 25 can be lifted against the downward urging of arms 26. The pages of the book held on table 18 by clamp 24 may be turned by lifting the book by its lower edge, thus raising tongue 25, pulling the book out from under the tonque, turning the page, and putting it back.

If my device is reversed as previously mentioned to adapt it for use on the other side of the bed, clamp 24 is removed from the former upper edge of table 18, which edge becomes the lower edge when the apparatus is reversed, and clipped over the edge that becomes the upper edge of the reversed table.

Clamp 24 may be inverted to hold reading material against the underside of table 18 if desired. If used in this way table 18 would not have to be transparent because the reading material would be held face down with its back against the table.

A suitable lighting fixture may be attached to my apparatus. One such fixture is illustrated in the Stern patent mentioned above.

In the foregoing specification I have described a presently preferred embodiment of my invention; however, it will be understood that my invention can be otherwise embodied within the scope of the following claims.

I claim:

1. A bedside book holder for a flat table adapted to support reading material thereon comprising a flat table top, a flat base member adapted to be inserted between the mattress and spring of a bed, a first arm pivoted at one end on the outside end of the base member, a second arm pivoted at one end of the outside end of the base member spaced away from said flat table top from the first arm, first means pivotally attaching the other end of the first arm to the underside of the flat table adjacent a first end thereof, a riser portion on the other end of the second arm, and second means pivotally attaching the free end of the riser portion to the underside of the flat table adjacent its first end but spaced from the first means, the second arm being longer than the first arm.

2. Apparatus of claim 1 in which the lengths of the first and second arms are proportioned so that when the second arm is horizontal the flat table is vertical.

3. Apparatus of claim 1 in which the riser portion of the second arm is detachable and affixable to the second arm to project therefrom in either of two directions opposite each other and in which the first means are detachable and affixable to the table top adjacent either side thereof whereby the apparatus is adapted for use on either side of a bed.

4. Apparatus of claim 1 in which the pivot of the first means is spaced from the table top a distance less than the distance of the pivot of the second means from the table top.

5. Apparatus of claim 1 in which the first and second arms are pivoted on the base member so as to move in parallel planes spaced from each other.

6. Apparatus of claim 1 in which the second means are centrally located with respect to the width of the table top.

* * * * *